US008657113B1

(12) United States Patent
McCauley

(10) Patent No.: US 8,657,113 B1
(45) Date of Patent: Feb. 25, 2014

(54) TOOL STORAGE AND BOLT ORGANIZER DEVICE

(71) Applicant: Kenneth G. McCauley, Dallas, TX (US)

(72) Inventor: Kenneth G. McCauley, Dallas, TX (US)

( * ) Notice: Subject to any disclaimer, the term of this patent is extended or adjusted under 35 U.S.C. 154(b) by 0 days.

(21) Appl. No.: 13/755,679

(22) Filed: Jan. 31, 2013

(51) Int. Cl.
*B25H 3/06* (2006.01)
*B25H 1/04* (2006.01)

(52) U.S. Cl.
USPC ..... 206/373; 206/564; 206/372

(58) Field of Classification Search
USPC ..... 206/373, 372, 459.1, 459.5, 376, 378, 206/564; 211/70.6, 69, 126.6, 133.1, 85.18; 248/127
See application file for complete search history.

(56) References Cited

U.S. PATENT DOCUMENTS

| | | | | | |
|---|---|---|---|---|---|
| 1,389,486 | A | * | 8/1921 | Brewer | 33/562 |
| 2,514,735 | A | | 7/1950 | Wilson | |
| 3,106,295 | A | | 10/1963 | Berlin | |
| 3,168,061 | A | * | 2/1965 | Bedol | 108/116 |
| 3,265,019 | A | * | 8/1966 | Haydock | 108/119 |
| 3,349,727 | A | * | 10/1967 | Schroer et al. | 108/119 |
| 3,726,393 | A | * | 4/1973 | Thompson | 206/378 |
| 4,119,044 | A | | 10/1978 | Hines | |
| 4,168,669 | A | * | 9/1979 | Arnoff | 108/116 |
| 4,284,603 | A | * | 8/1981 | Korom | 422/534 |
| 4,467,927 | A | * | 8/1984 | Nathan | 211/153 |
| 5,071,004 | A | * | 12/1991 | Rivera | 206/373 |
| 5,181,681 | A | | 1/1993 | Edwards | |
| 5,302,014 | A | * | 4/1994 | Hobson | 312/249.12 |
| 5,313,181 | A | * | 5/1994 | Negus | 335/285 |
| 5,483,901 | A | | 1/1996 | Tisbo | |
| 5,544,744 | A | | 8/1996 | Oman | |
| 5,685,085 | A | * | 11/1997 | Bond | 33/555.3 |
| 6,116,425 | A | * | 9/2000 | Frayer, Sr. | 206/557 |
| 6,240,856 | B1 | | 6/2001 | Paskey | |
| 6,640,981 | B2 | * | 11/2003 | Lafond et al. | 211/74 |
| 6,688,634 | B2 | | 2/2004 | Noffsinger | |
| 6,901,672 | B1 | * | 6/2005 | Reilly | 33/501.45 |
| 7,263,932 | B2 | | 9/2007 | Winter | |
| D637,500 | S | * | 5/2011 | Corbin | D10/64 |
| 2008/0229598 | A1 | * | 9/2008 | Liu | 33/562 |

* cited by examiner

*Primary Examiner* — Steven A. Reynolds

(57) ABSTRACT

A tool storage and bolt organizer device (10) is provided having a tray top (11) including a bolt storage rack (21), and hex head bolt size gauges (19) and (20). A modular bolt storage rack (26) is removably coupled to the bolt storage rack (21) providing for additional bolt storage. The tray top (11) is preferably constructed by a plastic injection molding process and the support frame (35) preferably includes a first leg (38) and a second leg (39) that are pivotally connected. The legs desirably have a generally X-shaped configuration when the legs are placed an upright position and the legs can be collapsed into a storage position. The support frame (35) can be connected to the tray top (11) by inserting the legs (38) and (39) into the clamps (25) to fully erect the tool storage and bolt organizer device (10). The legs (38) and (39) can detached and the tray top (11) can be utilized by itself where the clamps (25) can function as a base to rest on a surface.

4 Claims, 7 Drawing Sheets

TOOL STORAGE AND BOLT ORGANIZER DEVICE

BACKGROUND

1. Field of Invention

This invention relates to a tool storage and bolt organizer device used for storing tools, bolts, screws or any other similar type fasteners specifically, to store and organize bolts, screws or similar fasteners during the process of disassembly of machinery or anything that would incorporate similar fasteners in an orderly manner.

2. Description of Prior Art

Mechanics and the like working on machinery, automobiles or other equipment have a need for the ready accessibility of a lightweight and portable storage device. During the disassembly process of machinery or other equipment, bolts, screws or other similar fasteners are removed from the machinery. As each bolt, screw and fastener is removed, they must be stored by some method easily accessible to the mechanic. Tools used during the disassembly and assembly process must also be stored.

Some mechanics will temporarily place their tools, bolts and screws on top of the frame of the machinery or any other place within easy reach. If the mechanic is repairing a vehicle he might temporarily store his tools and bolts on the top of the engine, on top of the radiator, fender well, or the top of the air cleaner.

The problem with this type of storage is that invariably the tools and bolts have a tendency to become jostled and fall through the engine compartment onto the ground beneath the vehicle, or the mechanic will forget where he placed the tools and bolts.

Another method would be to store the bolts, screws, and other similar fasteners in cans or other similar containers. This random method of storing bolts, screws and fasteners can lead to confusion during the reassembly of the machine due to the uncertainty of the replacement of the original fastener in the original position. As each bolt or screw is removed, it is advantageous to store them in sequential order. This aids in the assembly of the machinery by simply reversing the order the bolts and screws were originally stored. It may also be necessary for the mechanic to work underneath the vehicle and would need a way of storing the tools and bolts.

It may also be necessary for the mechanic during the course of making repairs to identify different hex sizes of the heads of the bolts and nuts.

Various tool holders, caddies, and tables have been proposed which address these problems or which have certain features bearing some similarity to the claimed invention.

U.S. Pat. No. 3,168,061, issued Feb. 2, 1965 to Marshall T. Bedol, describes a convertible folding snack table having a rectangular table top with U shaped legs wherein they form a X-shaped stand for the table top. U.S. Pat. No. 4,119,004, issued Oct. 10, 1978 to Ralph E. Hines, shows a wheeled tool caddy with a horizontal platform from which a post projects rigidly upward near one margin of the platform. U.S. Pat. No. 5,544,744, issued Aug. 13, 1996 to John I. Oman, discloses an engine parts organizer with open bins and a plurality of through holes. U.S. Pat. No. 6,688,634 B2, issued Feb. 10, 2004 to Alfred Ace Noffsinger, shows a foldable tool cart with a plurality of holes and an upper tray supported by a lower base.

While these devices fulfill their respective, particular objective and requirements, the aforementioned patents do not include all of the features and advantages of the tool storage and bolt organizer device.

The components used in fabricating prior art foldable tray tables and tool caddies are disclosed typically made of metal and require many different parts in the assembly. This can be expensive both in fabrication of extra parts and labor costs for added assembly.

SUMMARY

The tool storage and bolt organizer device provides a foldable tray constructed of a durable plastic material such as polyethylene by a plastic injection molding process which will produce an inexpensive tray with folding tubular metal legs for temporarily storing hand tools and small parts in a flat portion of the tray top and storing in an orderly fashion, bolts and other similar fasteners in a bolt storage rack portion of the tray. Both the tray top and the bolt storage rack are molded as part of the whole tray during the plastic injection molding process.

Another objective of the present invention is to provide a bolt hex size gauge for both metric and inch dimensions which are molded as part of the whole tray during the plastic injection molding process.

Yet another objective of the present invention is to provide a lightweight and portable tray that can be detached from the tubular metal legs and used separately to lay on the floor while working underneath a vehicle or can be easily positioned in the engine compartment of a vehicle or on top of a large vehicle or machine.

Still another objective is to provide a quick and easy method of adding a modular bolt storage rack to the tray for additional storage capacity for bolts.

A further objective of the present invention is to provide clamps on the underside of the tray which are molded as part of the whole tray during the plastic injection molding process for attaching the tray to the tubular metal legs. The clamps are also used as a base, when the tray is used separately from the tubular metal legs.

An additional objective of the present invention is to provide a vertical wall positioned around the periphery of the tray top to prevent the contents of the tray top from falling off. The wall is molded as part of the whole tray during the plastic injection molding process.

Another objective of the present invention is to provide the tray with structural support by ribbing along a underside of the tray which are also molded as part of the whole tray during the plastic injection molding process.

A further objective is to provide a collapsible structure which may be stored in a small space and quickly erected when needed.

The above objectives and other objectives of the present invention are obtained by providing the tool storage and bolt organizer device which includes a tray having a top surface comprising of a flat tool storage area which includes hex bolt size gauges graduated in inch and metric, a vertically extending wall around the periphery of the top of the tray and a bolt rack. The tray has an underside which includes structural supportive ribbing extending generally along the width of the tray and spaced clamps which are located along the front and back edges which attach the metal tubular legs to the tray and the clamps are also used as a base when the tray is used without the supporting frame.

The above and other objectives, features, and advantages of the present invention will become apparent upon consideration of the detailed description and the appended drawings.

DETAILED DESCRIPTION OF THE INVENTION

Figure 1:
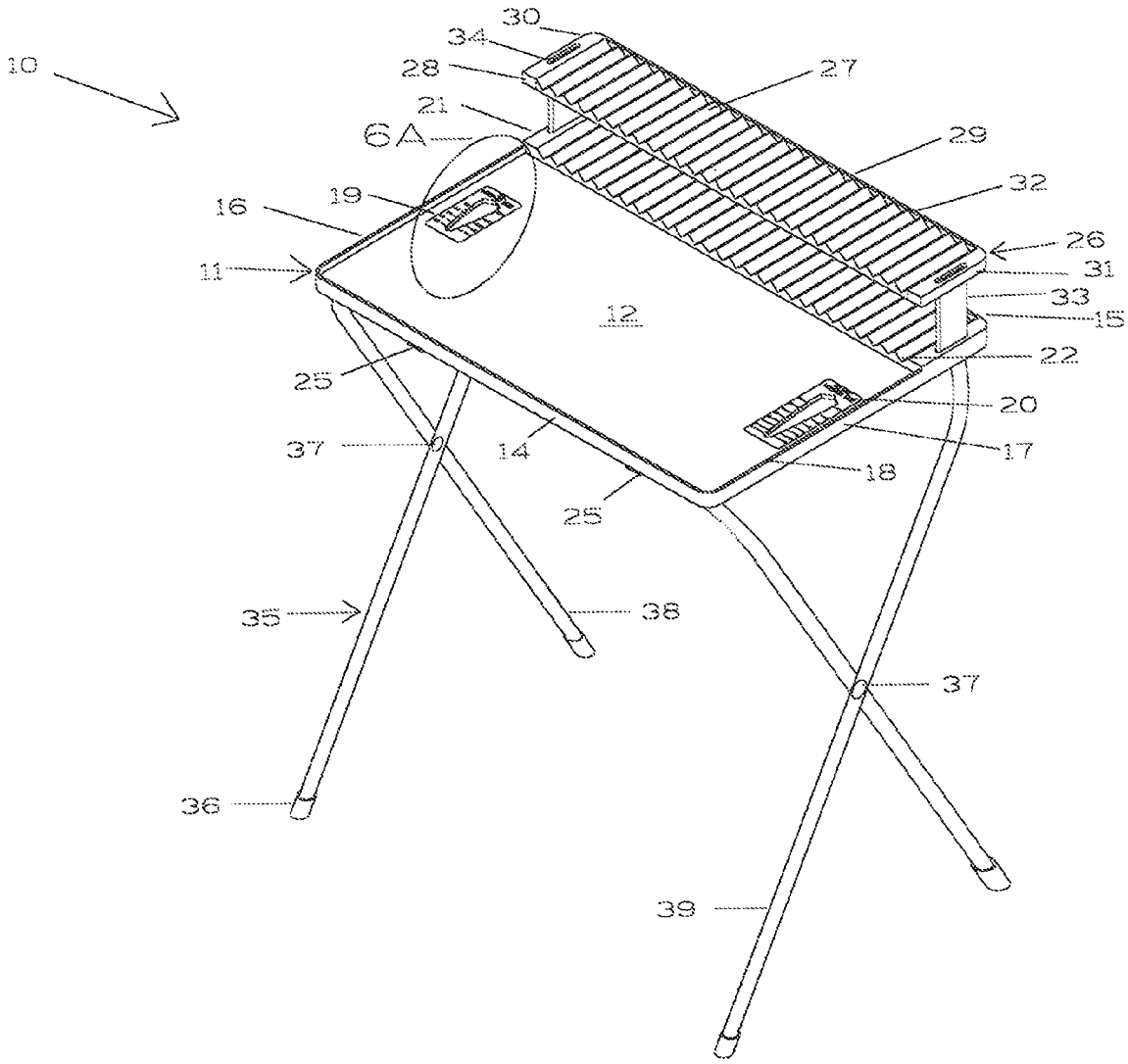
FIG. 1 is a perspective view of one embodiment of the present tool storage and bolt organizer device in its fully assembled and upright standing condition.

Referring now to the drawing, and in particular to FIG. 1, an improved tool storage and bolt organizer device 10 is illustrated. As shown in FIG. 1, the tool storage and bolt organizer device 10 includes a tray 11 preferably rectangular in shape, having a front edge 14, a opposite back edge 15 and two shorter side edges 16 and 17 with a vertical wall 18 therearound extending perpendicularly above and below a top surface 12, and is fabricated from a durable plastic such as polyethylene by a plastic injection molding process, producing one piece construction of the tray 11.

Figure 4:
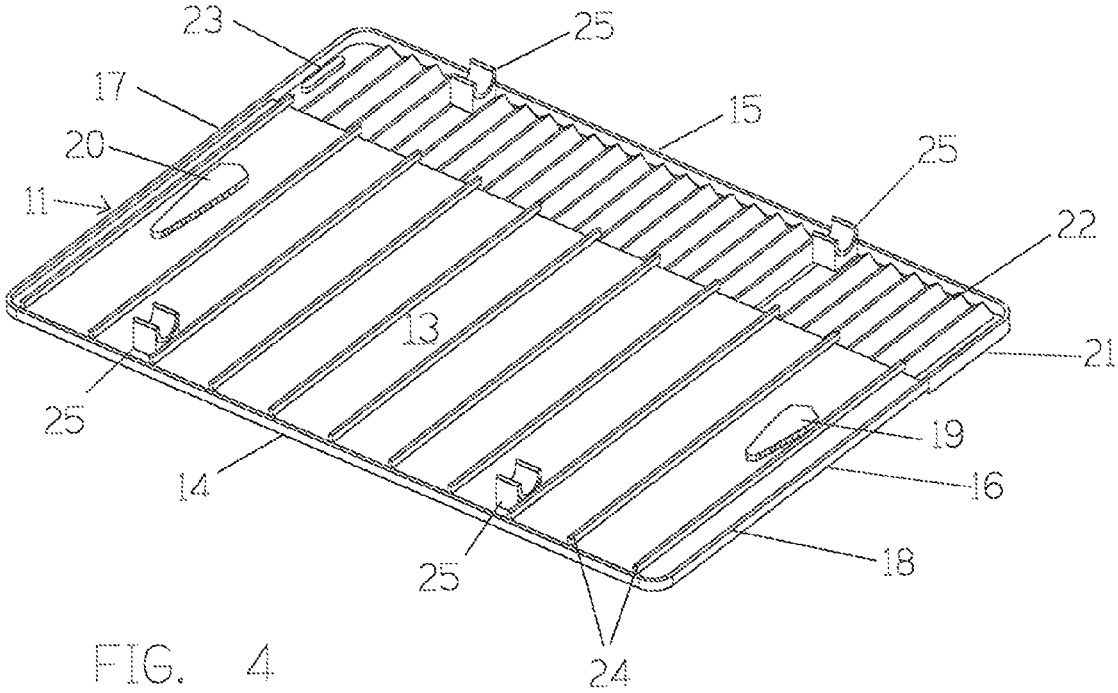
FIG. 4 is a perspective view of the underside of the tray showing the supportive ribbing and clamps, the underside of the bolt gauges, the underside of the receptacle for the standoff legs of the modular bolt rack, the vertical wall around the underside periphery of the tray and the underside of the bolt rack.

An underside 13, illustrated in FIG. 4, has four spaced clamps 25 molded as part of the whole tray 11 on the underside 13, and along the front edge 14 and the opposite back edge 15 provide a snap-on mount of a support frame 35 of FIG. 1.

Figure 2:
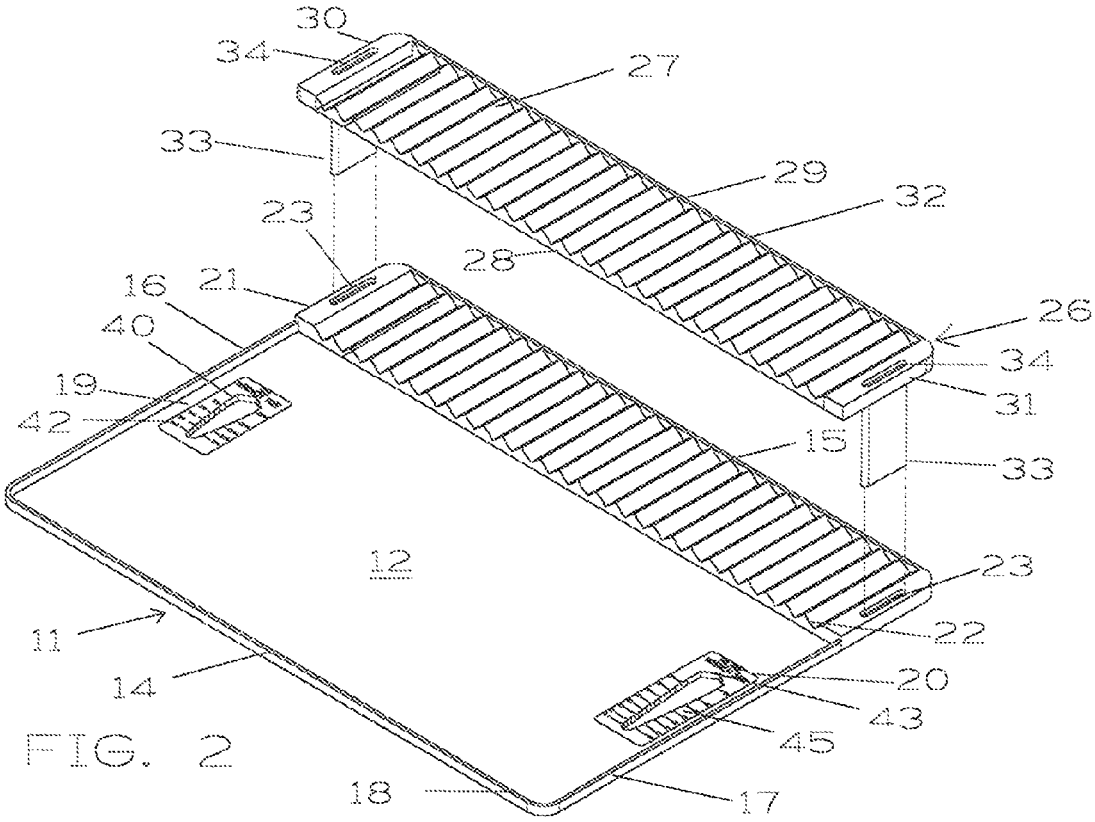
FIG. 2 is a perspective view of the tray detached from the foldable legs and the modular bolt rack detached from the tray.

Referring to FIG. 2, the tool storage and bolt organizer device 10 also includes a bolt storage rack 21 extending along the opposite back edge 15 and being elevated above the top surface 12. The bolt storage rack 21 is composed of a plurality of adjacent angled V-slots 22 which are approximately but not limited to 45 degrees relative to the horizontal surface of top 12, extending perpendicularly from the opposite back edge 15 approximately four inches toward the middle of the tray 11.

Figure 3:
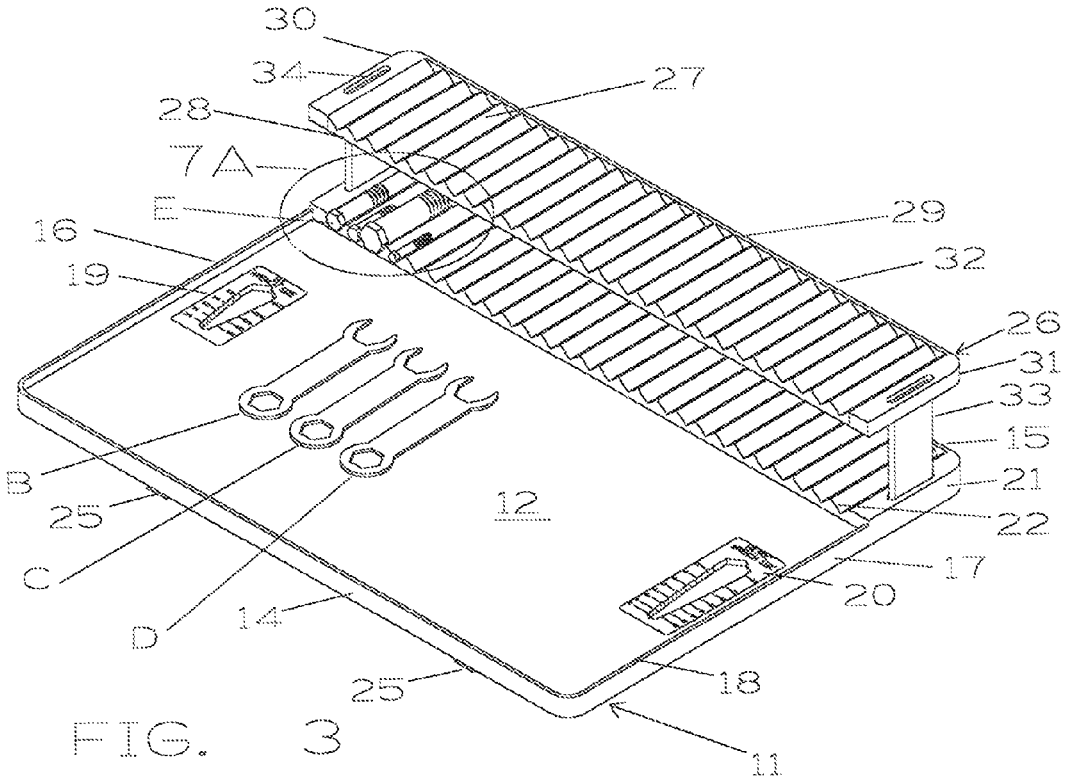
FIG. 3 is a perspective view of the tray detached from the foldable legs and the modular bolt rack attached showing an example of tools being stored on the flat portion of the tray top and bolts being stored in the bolt rack.
Figure 7A:
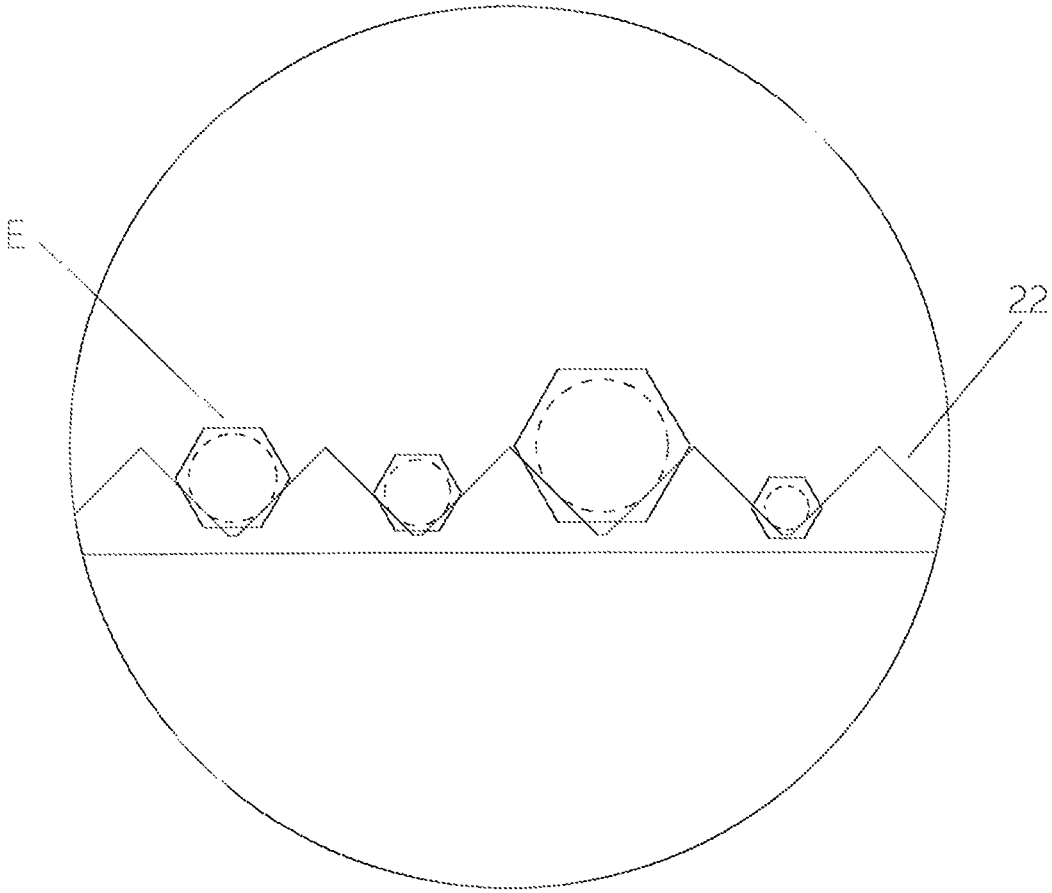

Referring to FIGS. 3 and 7A, illustrate how each V-slot 22 accepts different size diameter bolts E which is significant because this allows each bolt to be stored in sequential order (regardless of diameter size) as they are removed from the machinery. The bolt storage rack 21 also contains a pair of receptacles 23 which can best be seen in FIG. 2, which receive a pair of standoff legs 33 of a modular bolt storage rack 26. The receptacles 23 are disposed one each along and adjacent to each of the shorter sides 16 and 17 of the tray 11, being an elongated slotted pocket which provides an opening on the horizontal surface of the bolt storage rack 21 extending vertically downward and terminates at a bottom of the pocket which is a surface parallel to the top surface 12. The receptacles 23 provide a snap fit for the standoff legs 33 of the modular bolt storage rack 26, so that the modular bolt storage rack 26 can be easily removed when not required for storing additional bolts.

The modular bolt storage rack 26 is preferably of injection molded plastic construction of a polyethylene plastic material producing a one piece molded part, consisting of a plurality of adjacent angled V-slots 27 which are approximately but not limited to 45 degrees relative to a horizontal plane extending from the opposite back edge 29 of the modular bolt storage rack 26 perpendicularly and terminate at a front edge 28 of the modular bolt storage rack 26. The pair of standoff legs 33 mate with the receptacles 23 or receptacles 34 by being inserted into place creating a snap-fit for either the bolt storage rack 21 of the tray 11 or another modular bolt storage rack 26. The standoff legs 33 are of sufficient height to allow easy access of bolts being stored on the bolt storage rack 21 below.

Figure 6A:
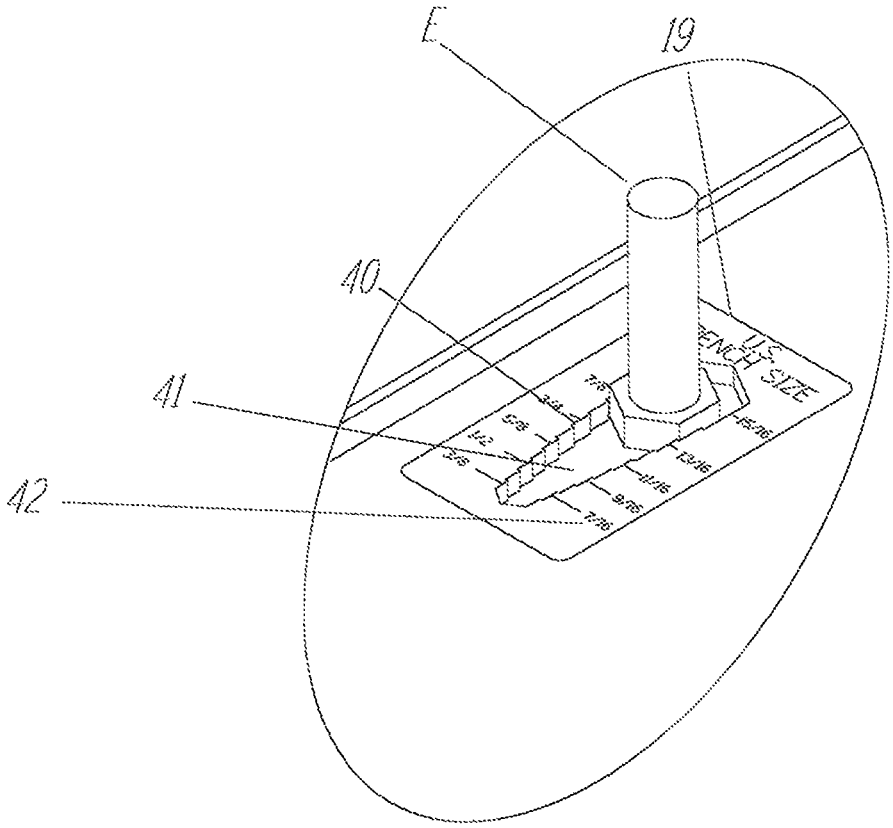
FIG. 6A is a respectively enlarged view of the area 6A of FIG. 1; and, FIG. 7A is a respectively enlarged front view of the area 7A of FIG. 3.

As shown in FIG. 6A, a inch hex head bolt size gauge 19 is formed as part of the tray top 12 of FIG. 1 as a result of the plastic injection molding process. In FIG. 6A, the inch hex head bolt size gauge 19 consists of a plurality of parallel slots 40, being of sufficient length to allow parallel sides of a hex head of a bolt E being measured, to be aligned sufficiently for proper measurement, with the parallel slots 40 also having vertical walls. The vertical walls of the parallel slots 40 extend in a vertically downward direction and terminate at a junction of a floor 41 at a depth sufficient to allow penetration of the hex head of the bolt E being measured to rest on the floor 41. The parallel slots 40 extend axially along the length of the inch hex head bolt size gauge 19 and are graduated with each successive parallel slot 40 being narrower than the previous parallel slot 40 from top to bottom. With two parallel sides of the hex head of bolt E aligned with the parallel slots 40, bolt E can be physically moved starting at the widest of the parallel slots 40 at the top, toward the bottom of the inch hex head bolt size gauge 19 until it reaches the parallel slot 40 which is narrower than the parallel sides of the hex head of bolt E. At this point the bolt E can move no further. The size of the hex head of bolt E can now be determined by reading a numerical hex head size identifier 42 located adjacent to each of the individual parallel slots 40. A metric hex head bolt size gauge 20, best seen in FIG. 2, is identical to the inch hex head size gauge 19 except a plurality of parallel slots 43 and numerical metric hex head size bolt identifiers 45 are graduated in millimeters.

Figure 5:
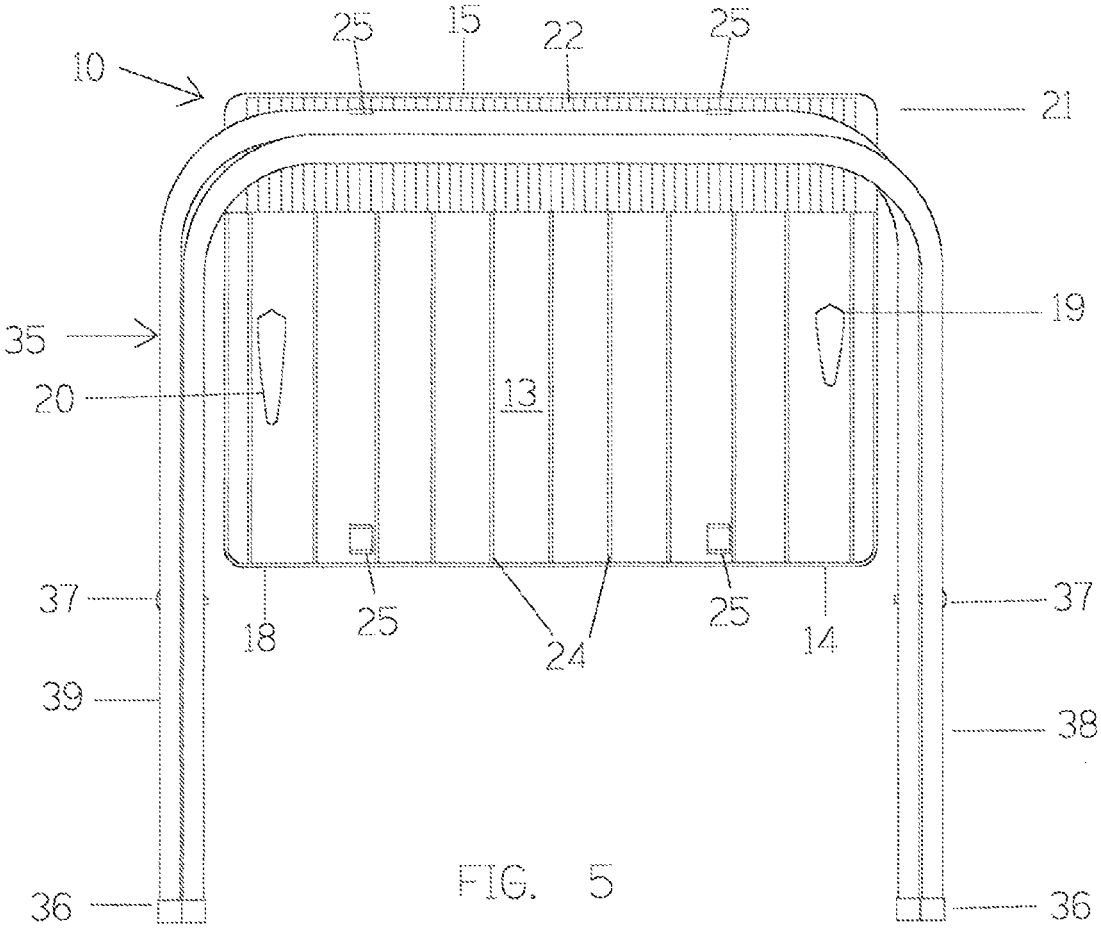
FIG. 5 is a plan view of the tray of FIG. 1 in a fully folded and flat condition with the underside of its tray facing up.

Referring now to FIGS. 4 and 5, show a reinforcement ribbing 24 located on the under side 13. In FIGS. 4 and 5, the reinforcement ribbing 24 is equally spaced along the length and extend in the direction of the width with a height equal to the vertical wall 18.

As shown in FIG. 1 reference numeral 35 indicates a support frame which is engaged by the tray clamps 25 when the device is erected to form the tool storage and bolt organizer device 10 seen in FIG. 1. The support frame 35 consists of two U-shaped legs 38 and 39.

The legs are pivotally connected at the midpoint of each vertical section of the legs 38 and 39 through pivot pins 37. The support frame 35 is preferably made of tubular steel in order to provide a maximum of rigidity with a minimum of weight.

Wherein the legs 38 and 39 form an X-shaped supporting frame 35 for the tray 11 which is mounted thereon through the tray clamps 25 to form the fully extended tool storage and bolt organizer device 10. The open ends of each leg can be covered with plastic caps 36 of FIG. 1.

FIG. 5 shows the tool storage and bolt organizer device 10 in its fully collapsed condition, ready for storage. With the leg 38 being disengaged from clamps 25, this allows the legs 38 and 39 to be flat against the underside 13 and be in a somewhat parallel position.

To form the tool storage and bolt organizer device 10, shown in FIG. 1, the tray clamps 25 should be disengaged from the legs 38 and 39, are then swung open to form the X-shaped support frame 35 and the tray clamps 25 should be engaged to the horizontal sections of the legs 38 and 39.

It is to be understood that the present invention is not limited to the sole embodiments described above, but encompasses any and all embodiments within the scope of the following claims. It will also be understood that the dimensions recited in the foregoing description are provided for purposes of enabling the disclosure by example and not by way of limitation. The actual dimensions of the tool storage and bolt organizer device 10 may vary and still be within the scope of the invention as claimed.

What is claimed is:

1. A tool storage and bolt organizer device for storing tools, fasteners, and small parts, comprising:

a tray rectangularly shaped having a top surface, an underside, a front edge, a back edge opposite to said front edge and two shorter side edges, said tray having four vertical walls extending above and below said top surface disposed about the periphery of said tray, said tray having a bolt rack formed along and extending from said back edge, at least one hex head bolt gauge formed on said top surface, four spaced clamps formed on said underside, with two of said clamps being formed, spaced along said front edge with two of said clamps being formed, spaced along said back edge, means for reinforcing said tray provided on said underside;

a modular bolt rack rectangularly shaped having a front edge, a back edge opposite to said front edge and two shorter side edges, said modular bolt rack having a plurality of V-shaped elongated slots along and extending perpendicularly from said back edge to said front edge, with a vertical wall extending upward along said back edge, said modular bolt rack having two standoff legs extending downward with one said standoff leg disposed along each said shorter edge thereof, means to removably couple said modular bolt rack with said tray;

and, a support frame consisting of a pair of U-shaped leg members, wherein leg portions of which are longer than cross pieces thereof, means pivotally connecting the side portions of said U-shaped legs in crossed relation to one another.

2. The tool storage and bolt organizer device as defined in claim 1 wherein the bolt rack being formed by a plurality of adjacent slots along and extending perpendicularly from said back edge, containing a pair of receptacles disposed one each adjacent to each said side edge within said bolt rack.

3. The tool storage and bolt organizer device as defined in claim 1 wherein said hex bolt gauge comprising of a series of parallel slots connected end to end, with each successive pair of said slots being narrower in width, with each said parallel slot having a vertical wall extending in a downward direction terminating at a floor of said hex head bolt gauge and having a numerical size identifier adjacent to each said parallel slot.

4. The tool storage and bolt organizer device as defined in claim 1 wherein said clamps form a means of securing said support frame to said tray and said clamps act as a base allowing said tray to rest on a surface when said tray is detached from said support frame.

* * * * *